US009328595B2

(12) United States Patent
Kjørholt

(10) Patent No.: US 9,328,595 B2
(45) Date of Patent: May 3, 2016

(54) SINGLE WELL STREAM ASSISTED GRAVITY DRAINAGE

(75) Inventor: Halvor Kjørholt, Stavanger (NO)

(73) Assignee: STATOIL ASA, Stavanger (NO)

( * ) Notice: Subject to any disclaimer, the term of this patent is extended or adjusted under 35 U.S.C. 154(b) by 969 days.

(21) Appl. No.: 13/201,369

(22) PCT Filed: Feb. 10, 2010

(86) PCT No.: PCT/GB2010/000241

§ 371 (c)(1),
(2), (4) Date: Oct. 4, 2011

(87) PCT Pub. No.: WO2010/092338

PCT Pub. Date: Aug. 19, 2010

(65) Prior Publication Data

US 2012/0043081 A1 Feb. 23, 2012

(30) Foreign Application Priority Data

Feb. 13, 2009 (GB) ..... 0902476.1

(51) Int. Cl.
*E21B 43/24* (2006.01)
*E21B 43/30* (2006.01)

(52) U.S. Cl.
CPC ..... *E21B 43/2406* (2013.01); *E21B 43/305* (2013.01)

(58) Field of Classification Search
USPC ..... 166/245, 50, 52
See application file for complete search history.

(56) References Cited

U.S. PATENT DOCUMENTS

| | | | | |
|---|---|---|---|---|
| 4,577,691 | A | 3/1986 | Huang et al. | |
| 5,148,869 | A | 9/1992 | Sanchez | |
| 5,511,616 | A * | 4/1996 | Bert | 166/272.7 |
| 6,015,015 | A | 1/2000 | Luft et al. | |
| 6,230,814 | B1 * | 5/2001 | Nasr et al. | 166/400 |
| 2005/0211434 | A1 | 9/2005 | Gates et al. | |

FOREIGN PATENT DOCUMENTS

WO WO 00/23688 A1 4/2000

* cited by examiner

*Primary Examiner* — Angela M DiTrani
(74) *Attorney, Agent, or Firm* — Birch, Stewart, Kolasch & Birch, LLP

(57) ABSTRACT

A method for recovering hydrocarbons from a sub-surface reservoir having present therein a wellbore in which a production conduit and an injection conduit are located includes injecting a heating fluid into the reservoir via said injection conduit where the heating fluid is released via a plurality of discrete permeable sections located along the length of the injection conduit and produced hydrocarbons are collected via a plurality of discrete permeable sections located along the length of the production conduit.

12 Claims, 3 Drawing Sheets

PRIOR ART

SINGLE WELL STREAM ASSISTED GRAVITY DRAINAGE

The present invention relates to methods and wells for the production of hydrocarbons from heavy oil reservoirs.

Heavy oil reservoirs, e.g. tar sands, contain deposits of dense hydrocarbons (commonly known as bitumen). These dense hydrocarbons are usually immobile or of very low mobility at the reservoir temperatures. Typical temperatures for low temperature oil sands are in the region of 5 to 15° C., however some areas have hydrocarbons with low mobility, even at higher temperatures. Heavy oil reservoirs are typically relatively shallow and horizontal wells are commonly used in order to present a greater proportion of the well to the hydrocarbon-bearing formation.

In order to extract heavy oil from formations, the problems of high viscosity and the resulting low mobility of the hydrocarbons must be overcome. Common methods for stimulating hydrocarbon production include injection of well-treatment compositions, such as acids or solvents, and in-situ heating of the formation, for example with steam, in order to reduce the viscosity of the hydrocarbons and thus stimulate hydrocarbon production.

Among the most commonly used technologies for producing hydrocarbons from low temperature oil sands is Steam Assisted Gravity Drainage (SAGD). This is illustrated in FIGS. 1A and 1B, FIG. 1B being a cross-section, A-A, of the well pair of FIG. 1A and neighbouring similar well pairs. In a typical SAGD process, horizontal pairs of wells are drilled in the reservoir with a lateral spacing (between the pairs) of approximately 100 m (see 1.6 in FIG. 1B). Each well-pair consists of an injector well (1.1) and a producer well (1.2). The producer is drilled close to the base of the reservoir and the injector parallel to this and around 5 m above (see 1.5 in FIG. 1B). When the wells are completed, steam is circulated in both wells to "melt", and thus increase the mobility of, the extremely viscous hydrocarbons situated around the two wells. When communication is established between the wells (this usually takes a few weeks) the producer well is recompleted to its primary purpose as oil producer. The upper injector well continues to inject steam to melt more hydrocarbons in the vicinity of the wells. The mobilised hydrocarbons flow down to the producer well, where they are pumped to surface. The drained area is shown in FIG. 1B, for example as 1.3.

A well-pair of this type typically produces between one and two million barrels of oil over a lifetime of around five to ten years. However, as it requires two wells, conventional SAGD is only economically feasible for a certain thickness of sand bed, depending on the oil price. This is a problem because a large proportion of hydrocarbon reserves exist in thin layers and thus hydrocarbons can not be produced economically from such reserves with existing technology. Furthermore, the use of well-pairs results in wedges of hydrocarbon remaining undrained between the pairs of traditional SAGD wells (see, for example 1.4 in FIG. 1B).

For these reasons, alternative versions of SAGD have been proposed, for example, single-well versions in which steam injection takes place at the toe-end of an injection tube within a well in which the production tube also resides. In order to avoid steam entering the production tube or oil entering the injection tube (an undesirable situation, commonly known as "short-circuiting") production is distanced from injection in such a well configuration, i.e. production takes place at the heel-end of the well, whereas injection is at the toe-end. Although such toe-end injection does not distribute steam throughout the whole reservoir length evenly and production at the heel-end only is also not ideal, these configurations are used in order to avoid short circuiting.

As noted above, current methods have a number of drawbacks and thus alternatives for production of hydrocarbons from heavy oil reservoirs are desired, in particular methods and wells which address the afore-mentioned problems. In order to improve efficiency of hydrocarbon production, there exists a need for a method which increases production throughout the length (e.g. the length of the horizontal part) of a single well.

We have now realised that a single well may inject and produce throughout the length of a reservoir. The present invention provides a method which involves injection of a heating fluid (preferably steam, solvent, or a combination of these) in a well via a plurality of injection points (e.g. discrete sections on an injection tube) and production via a plurality of production points (e.g. discrete sections on a production tube). Effecting production and injection at a plurality of locations throughout the reservoir can lead to an increase in efficiency and the method of the present invention facilitates simultaneous injection and production throughout the length (e.g. the length of the horizontal part) of a single well.

Thus, in a first aspect, the present invention provides a method for recovering hydrocarbons from a sub-surface reservoir having present therein a wellbore in which a production conduit and an injection conduit are located, said method comprising injecting a heating fluid into the reservoir via said injection conduit, characterised in that said heating fluid is released via a plurality of discrete permeable sections (injection sections) located along the length of the injection conduit and produced hydrocarbons are collected via a plurality of discrete permeable sections (production sections) located along the length of the production conduit, preferably wherein said production sections and said injection sections are staggered in relation to one another.

The present invention also provides a well for use in the method described herein. Thus, viewed from a further aspect, the present invention provides a well for the recovery of hydrocarbons from a sub-surface reservoir, said well comprising a wellbore in which a production conduit and an injection conduit are located, characterised in that the conduits each comprise a plurality of discrete permeable sections for the passing of fluids, preferably wherein permeable sections in the conduits are staggered in relation to one another, such that the permeable sections located on the injection conduit (injection sections) are longitudinally distanced relative to the permeable sections located on the production conduit (production sections).

In both the method and the well of the invention, neighbouring injection sections are separated by non-permeable sections of conduit and neighbouring production sections are separated by non-permeable sections of conduit, i.e. each conduit comprises alternating permeable and non-permeable sections. Preferably, the part of the well in which the permeable sections of the conduits are located is horizontal, i.e. substantially horizontal. The permeable sections of conduit are preferably located throughout the length of the substantially horizontal part of the well, i.e. such that they are substantially regularly spaced (the interval between permeable sections being non-permeable sections of conduit) and such that several permeable sections are found in each conduit. Typically a conduit will comprise 2 to 600 permeable sections, preferably 5 to 450, especially 10 to 250, e.g. 15 to 50, or around 20. The injection and production conduits do not necessarily need to have the same number of permeable sections respectively, but will preferably have similar numbers of permeable sections.

A particular problem associated with the single well systems of the prior art is that of "short-circuiting" due to the proximity of the injection and production conduits in relation to one another. The prior art systems commonly comprise two conduits within a slotted well liner, the annulus being an empty void. The injected and produced fluids follow the path of least resistance and thus some of the heating fluid from the injection conduit is likely to enter the production conduit (i.e. the heating fluid "short circuits"), rather than exiting the lined well and entering and heating the surrounding formation. This leads to uneven heat distribution and difficulties in controlling the process.

In order to reduce short-circuiting in the method and well of the invention and thus increase the efficiency of extraction by facilitating simultaneous injection and production and promoting heat distribution in the formation, the injection and production sections are preferably separated from one another in some way. This may be achieved by staggering the injection and production sections (which, as described herein, are preferably sand screens or slotted sections) through which the heating fluid exits and oil, condensed and uncondensed heating fluid enters the injection and production conduits, respectively.

Therefore, in the method of the invention, the production sections and injection sections are preferably positioned such that they are staggered in relation to one another (i.e. the injection sections are not aligned with the production sections). Similarly, the well according to the invention will preferably comprise injection and production sections in the form of permeable sections in the conduits which are staggered in relation to one another, such that the permeable sections located on the injection conduit are longitudinally distanced relative to the permeable sections located on the production conduit. That is, in preferred aspect of the methods and wells of the invention, the well comprises an injection conduit with a plurality of permeable sections which are spaced along the conduit (being separated from one another by non-permeable sections) and wherein the permeable sections on the injection conduit are staggered in relation to permeable sections in the production conduit such that permeable sections on neighbouring conduits are never positioned adjacent (i.e. directly above/below or beside) one another.

Figure 2A:
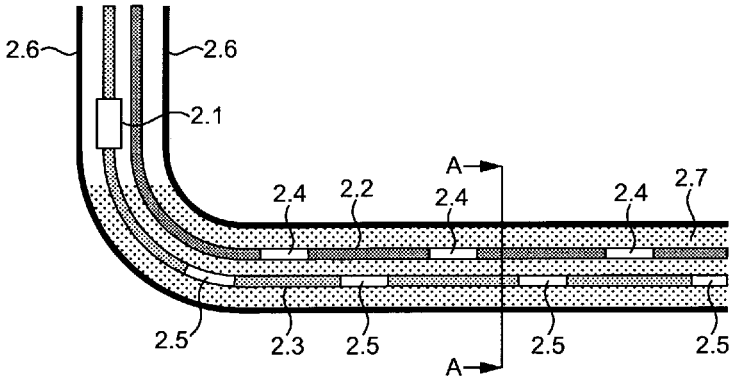
FIG. 2A illustrates a single well according to an embodiment of the present invention.
Figure 2B:
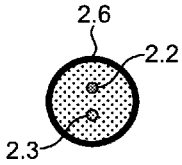
FIG. 2B is a cross-sectional view taken along line A-A of FIG. 2A.

FIG. 2 shows a single well according to the invention in which the injection and production sections are staggered in relation to one another. FIG. 2B is the cross-section (A-A) of FIG. 2A. 2.3 is the production conduit, which may contain pump (2.1) if required. Production conduit 2.3 and injection conduit 2.2 are located within a wellbore, the interface between the wellbore and the formation is illustrated by 2.6 and may include a lining, or, in the case of an unlined wellbore, may be merely the borehole/formation interface. Optionally, the annulus between the interface 2.6 and the conduits may be gravel-packed (2.7), otherwise the annulus may be open. FIG. 2A illustrates how injection sections, 2.4, are staggered in relation to the production sections, 2.5, such that an injection section is never positioned directly above a production section.

Figure 3:
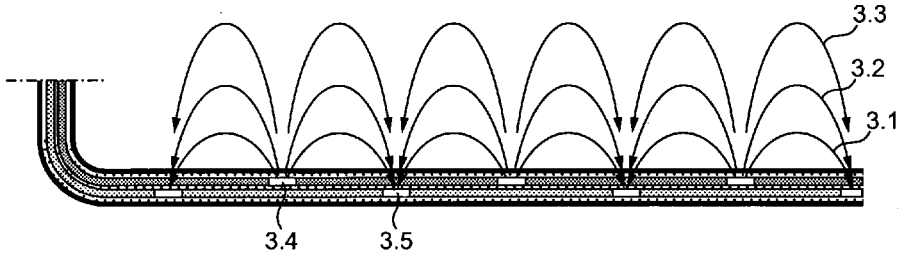
FIG. 3 illustrates a flow pattern in a single well according to an embodiment of the present invention.
Figure 4:
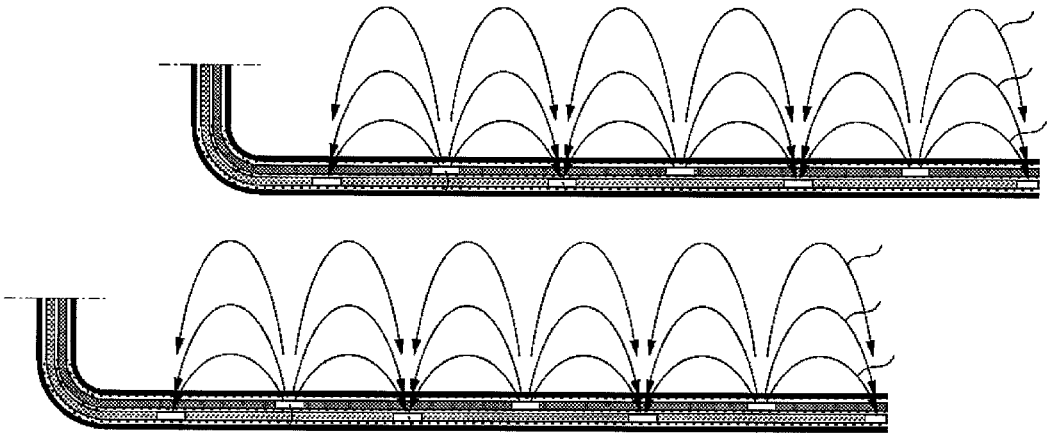
FIG. 4 illustrates neighbouring wells according to an embodiment of the present invention.

Staggering of the injection and production sections assists with distribution of the heating fluid by directing the fluid along the length of the well and into the reservoir to heat the formation in an efficient way. Without staggering, i.e. in instances where the respective sections are adjacent one another, the heating fluid may tend to flow directly from an injection section to the neighbouring production sections, thus wasting energy. FIG. 3 shows the principal flow patterns in the invention. The arrows show injection flow upwards and production flow downwards (as the viscous hydrocarbons in the formation melt and are brought down to the production conduit due to gravity). The height of flow increases with time, i.e. from 3.1 to 3.2 to 3.3 as the formation heats. FIG. 3 shows how the staggered arrangement of the injection (3.4) and production (3.5) sections avoid short circuiting. Flow models or measurements can be used to determine the ideal positions for the injection and production sections.

Staggering of the positions of the injection sections and the production sections in relation to one another thus enables injection and production throughout the length of the horizontal part of the well (preferably simultaneously), ensuring that hydrocarbons are produced throughout the length of the reservoir. Moreover, by avoiding short circuiting, the staggered arrangement forces the heating fluid into the reservoir rather than through the well as could be found in the prior art methods.

Thus viewed from a further aspect, the present invention provides a method for recovering hydrocarbons from a subsurface reservoir having present therein a wellbore in which a production conduit and an injection conduit are located, said method comprising injecting a heating fluid into the reservoir via said injection conduit, characterised in that said heating fluid is released via a plurality of discrete permeable sections (injection sections) located along the length of the injection conduit and produced hydrocarbons are collected via a plurality of discrete permeable sections (production sections) located along the length of the production conduit, wherein said production sections and said injection sections are staggered in relation to one another.

In a further aspect, the present invention provides a well for the recovery of hydrocarbons from a sub-surface reservoir, said well comprising a wellbore in which a production conduit and an injection conduit are located, characterised in that the conduits each comprise a plurality of discrete permeable sections for the passing of fluids, wherein permeable sections in the conduits are staggered in relation to one another, such that the permeable sections located on the injection conduit (injection sections) are longitudinally distanced relative to the permeable sections located on the production conduit (production sections).

In contrast to traditional double-well SAGD, the invention requires only a single wellbore containing two conduits to be situated in the reservoir. This allows more compact extraction apparatus to be used and therefore the method of the invention is likely to be applicable to thinner reservoirs than the two-well methods of the prior art. Moreover, as the present invention does not necessarily require casing or gravel packing in the horizontal section of the well, the costs associated with this can be avoided.

Preferably, the injection conduit will be located above the production conduit within the wellbore, however other configurations are possible. For example, the injection conduit need not be directly above the production conduit, it may be diagonally above. Alternatively, the conduits may be beside one another, e.g. substantially parallel in the same horizontal plane. It is preferred in all of these configurations that the injection sections are staggered in relation to the production sections.

A wellbore according to the invention may contain more than one injection conduit and/or more than one production conduit. For example, within a single wellbore, two upper injection conduits could be located above a lower production conduit, wherein the production conduit is located horizontally equidistant between the upper injection conduits. Preferably in all arrangements described herein, all neighbouring sections are staggered relative to one another, i.e. in the embodiment just mentioned, the injection sections of the injection conduits which are adjacent to one another in the horizontal plane would preferably be staggered in relation to one another and the production sections on the lower conduit would be staggered in relation to the injection sections of both upper injection conduits.

Likewise, a single wellbore may contain one upper injection conduit located above two lower production conduits, wherein the injection conduit is located horizontally equidistant between the lower production conduits. Alternatively, a single wellbore could contain more than one injection conduit and more than one production conduit in any configuration, however, injection conduits being located above (not necessarily directly above, they may be offset in the horizontal plane) production conduits are preferred.

The heating fluid used in the invention may be any fluid suitable for heating a formation such that viscous hydrocarbons are mobilised. Preferably the fluid is gaseous under the well conditions and soluble in hydrocarbons. The heating fluid preferably comprises one or more of steam, carbon dioxide, nitrogen, flue gas or $C_{1-6}$ hydrocarbons (e.g. $C_{1-4}$ hydrocarbons such as methane). Particularly preferably the heating fluid is steam, optionally in combination with one or more of carbon dioxide, nitrogen, flue gas and $C_{1-6}$ hydrocarbons (e.g. $C_{1-4}$ hydrocarbons such as methane). Also preferred as heating fluid is $C_{1-6}$ hydrocarbons, optionally in combination with one or more of carbon dioxide, nitrogen, flue gas and steam.

As with any SAGD-type oil-production method/well, the injection and production conduits contain sites which allow the passage of fluids, e.g. out-flow of the heating fluid into the formation from the injection conduit and the passage of released hydrocarbons into the production conduit (in-flow). In the present invention these sites are permeable sections which prevent the passage of undesirable components such as loose sands or gravel into the wellbore from the surrounding formation, while allowing the desired fluids (e.g. steam, condensed water and hydrocarbons) to exit/enter. In any one conduit, the permeable sections are not continuous, they are separated from one another by non-permeable sections. Screening or filtering sections such as sand screens or slotted liners (i.e. slotted sections of conduit) are preferred means of achieving the desired level of permeability, i.e. in a preferred embodiment, the permeable sections are sand screens. By "permeable" is meant that the section of the conduit in question is permeable to the heating fluid and/or hydrocarbons.

The screen sections (e.g. sand screens) preferred for use as the permeable sections of the conduits of the invention may be any suitable for the purpose and would be readily apparent to the person skilled in the art. Screens are typically filter-tubes which allow hydrocarbon flow and steam to pass through, but inhibit the passing of gravel and formation sand. Stand alone screens or open-hole (or external) gravel packs, which comprise a sized sand placed in an annular arrangement around the screen, may be used. The screens typically comprise wire meshes, woven metal cloths and the like.

Typically the conduit screens are made of metal, such as Carbone steel, high quality steel (for instance 316L) or nickel based alloys (for instance Inconel) which limit corrosion. Typical pore size (diameter) or slot size (aperture or width) is in the range 0.05 mm to 2.0 mm, especially 0.1 mm to 1.0 mm, most preferably 0.2 mm to 0.5 mm. Screens may comprise slots, pores, so-called wire wrap, woven metal cloth, sintered metal fibres, or a pipe with sawn slots, i.e. a so-called slotted liner or any other suitable screen filtration media.

The permeability of the injection and/or production sections may be controlled using an external gravel pack. Typical values for permeability of such gravels range from 10 to 300 Darcy, especially 20 to 200 Darcy, particularly preferably 50 to 150 Darcy. Examples of preferred permeable sections include those surrounded by a 12/20 mesh carbolite with permeability 200 Darcy or an Ottawa sand 20/30 mesh with permeability around 30 Darcy. Especially preferred values for permeability of such gravels range from 10 to 2000 Darcy, especially 50 to 1000 Darcy, particularly preferably 100 to 800 Darcy. Examples of particularly preferred permeable sections include those surrounded by a 16/20 mesh carbolite with permeability 500-1000 Darcy or an Ottawa sand 20/30 mesh with permeability around 200 Darcy.

The injection and production conduits may be formed and inserted into the well by methods known in the art. However, in order to facilitate the staggering of the production and injection sections on the respective conduits, the permeable sections of the conduits are preferably incorporated (into the conduits) prior to insertion of the conduits into the sub-surface well. As mentioned above, most preferably, the sections are in the form of sand screens which are incorporated into the conduits prior to insertion of the conduits into the wellbore. This enables the precise layout of the permeable sections to be determined and the preferred staggered orientation to be achieved. As it may be difficult to adjust the configuration of the injection and production sections after well completion, the installation, location, length etc. may be decided in advance, based on numerical modelling of the expected flow.

The conduits for injection and production need not be identical in dimension. Typical diameters for the conduits are in the range 1 to 30 cm, preferably 5 to 15 cm, e.g. 7 to 12 cm. The two conduits may exist as two discrete tubes, or as a single tube comprising two separate channels. These channels are considered conduits for the purposes of the present invention. Co-axial conduit arrangements, e.g. where one conduit is placed within another, are less preferred. Preferably, the conduits are not physically linked to one another, i.e. they are two separate tubes.

The production conduit will typically be equipped with a pump near the heel of the well.

The injection conduit is one used primarily for injection of heating fluid and the production conduit is one used primarily for producing mobilized hydrocarbons, however, any one conduit may perform both functions (i.e. injection and production) at different stages of the process.

Each individual permeable section (e.g. screen) is preferably 1 to 30 m in length, especially 5 to 20 m. The permeable sections located in the injection conduit do not necessarily need to be the same size as those of the production conduit, nor do all of the permeable sections on any one conduit need to be the same size. For simplicity of construction, the permeable sections are preferably all of similar dimensions, however the dimensions may vary if required.

Likewise, the interval between adjacent permeable sections may vary within a conduits and between conduits, but is preferably constant. Typical values for the distance between respective sections on a conduit are from 10 to 150 m, for example 20 m to 100 m, especially preferably 40 to 80 m, e.g., around 50 m.

Typically, wellbore diameters are from 5 to 50 cm, especially 10 to 30 cm, preferably 15 to 25 cm. The depth of the hydrocarbon well may be any depth relevant for traditional SAGD. Typical values are from 70 to 1000 m. The horizontal section of the well may extend as far as necessary, e.g. up to 5000 m, for example 200 to 3000 m, preferably 500 to 2000 m into the reservoir.

The present invention allows simultaneous injection and production in the same well. In contrast, many known single well SAGD methods involve alternation between production and injection which may give uneconomical yields. In the present invention, injection and production may take place sequentially, i.e. alternating from one to the other, however, simultaneous injection and production are preferred, at least for some of the extraction process.

By achieving injection and production at a variety of locations along the length of the horizontal part of the well, while avoiding short circuiting, the method may be more efficient than prior art methods which tend to involve injection of steam only at the end of the production well, rather than at a plurality of locations. For example, "toe-end" injection seen in the prior art results in most of the heat being provided to the parts of the formation where the steam injection takes place, and gradually less as the distance (from the toe-end of the well) increases. Development of the steam chamber will thus not be as even as when the heating fluid is distributed along the reservoir due to injection along the length of the injection conduit. The present invention therefore improves the heat distribution along the length of the reservoir.

In a preferred aspect of the invention, one or both of the conduits according to the invention (i.e. an injection conduit and/or a production conduit) comprise devices to control the in-flow (e.g. of hydrocarbons) and out-flow (e.g. of the heating fluids). Such devices can improve heat distribution into the formation. Flow control may be achieved by designing the permeable sections such that they are more permeable near the toe of the well than near the heel in order to compensate for pressure loss in the injection/production conduits themselves. As an alternative, or in addition, the devices may be in the form of a restricted opening (such as a nozzle) which the flow must pass through at one or more of the injection sections of the injection tubing or at one or more of the inflow intervals in the production tubing. The cross section of the openings may be adjusted so that there is a certain pressure drop across them. This pressure drop can be designed by the choice of cross section of the opening.

In a particularly preferred embodiment of the present invention, gravel-packing is used to modify flow in the wellbore. Gravel packs are typically used in the art merely to hinder sand from being transported from the sand phase into the well. However, in a preferred aspect of the present invention, gravel is filled directly into the open hole, for at least the horizontal section of the well (i.e. there is no liner surrounding the gravel) such that it resides in the annulus between the conduits and the wellbore/formation interface. The gravel not only serves to hinder sand transport, but also provides a flow-path for the heating fluid and hydrocarbons.

Without wishing to be bound by theory, it is believed that the gravel-packing may help ensure a limited, but necessary, flow-path for the hydrocarbons from the formation to the production conduit and may assist with the avoidance of short-circuiting between the injection and production sections. This is illustrated in FIG. 3 which illustrates a typical flow pattern (heating fluid rising and hydrocarbon falling) for the method of the invention. It is noted that, as more hydrocarbon is mobilised and the formation becomes more permeable, the heating fluid penetrates further and further into the formation. FIG. 3 also illustrates how the staggering of the injection and production sections avoids significant instances of short circuiting. By altering the characteristics of the gravel-pack (e.g. particle size distribution), and the injection/production sections (e.g. permeability and spacing), the flow rates and paths of both the heating fluid and the produced hydrocarbon can be controlled.

The gravel-pack in the wellbore may help ensure that the flow is distributed evenly along the well, especially in early phases, i.e. until a large enough flow channel is established in the formation due to melting of the oil around (especially above and beside) the well. Once such a flow channel is established in the formation, the heating fluid can penetrate further into the formation (as illustrated by the increasing reach of the flow arrows, 3.1 to 3.3, in FIG. 3). The gravel may also perform a function with respect to sand control by keeping the wellbore stable and formation sand locked in place. In order to achieve this function, the gravel size should be chosen so that the formation sand can not flow through it. A commonly used criterion to use for this is the so-called Saucier criterion that specifies the mean gravel diameter in relation to the mean formation sand grain diameter.

The gravel size is chosen with regard to the characteristics of the surrounding formation, i.e. it should be sufficiently permeable so as to allow steam out and oil in, but selective enough to prohibit the entry of sand etc. from the formation into the conduits. Typical gravel size (diameter) is in the range 0.05 mm to 2.0 mm. Typical values for permeability of the gravel range from 10 to 2000 Darcy, e.g. 100 to 1000 Darcy, depending on gravel size distribution and type. Suitable examples are 12/20 or 16/20 mesh carbolite with permeability in the range 500-1000 Darcy or an Ottawa sand 20/30 or 20/40 mesh with permeability around 200 Darcy.

As noted above, the gravel pack may also perform the function of supporting the formation and thus preventing collapse of the formation. Formation collapse is undesirable as it can block the steam flow and thereby cause uneven steam distribution due to uneven flow resistance.

If necessary, permeable sections may have to be modified by closing (or less likely by opening) some of them after gravel packing. It may also be necessary to add an intermediate inner tube for return flow in one of the conduits (production or injection) during gravel packing.

As an alternative, or in addition, to use of a gravel pack, the horizontal reservoir section of the well may be lined in a similar way to conventional SAGD methods, for example using a screen or a slotted liner, the injection and production conduits being situated inside this liner. In the case where the liner is in the form of a screen, this may be an expandable screen which is inserted into the wellbore and expanded prior to insertion of the injection and production conduits (and prior to the insertion of the gravel pack, if used). The liner may provide extra support for the formation which surrounds the well and assist with sand control. In some instances the flow resistance along the wellbore for such a configuration may be limited when a gravel pack is not used because the steam is not forced to be distributed along the well to the same degree. Use of a gravel pack (alone or in combination with a liner) may provide good heat distribution throughout the reservoir section.

In the case where the well is lined, the liner may be formed from materials such as those previously mentioned in connection with the permeable sections of the conduits. However, while the permeable sections of the conduits are not continuous (i.e. they are separated from one another by non-permeable sections), the liner is preferably substantially permeable (i.e. the degree of permeability does not vary significantly except for necessary blank, i.e. non-permeable, sections due to manufacturing and installation reasons) throughout the length of the horizontal section of the well. In this way, it can be ensured that out-flow of heating fluids (from the injection sections to the formation), and in-flow of production hydrocarbons (from the formation and into the well towards the production sections) is not unnecessarily restricted. The liner may therefore preferably be in the form of a finely perforated screen, or (particularly for stable formations) a pre-drilled liner.

As the single well of the present invention can be located in smaller wellbores and narrower reservoirs than the conventional double well solutions, the extra stabilisation that liners and gravel packs can provide may not be required. Liners and gravel packs are therefore not essential to the present invention. Avoiding the use of a liner and/or a gravel pack provides a much simpler and cheaper method and well. Thus, in a preferred aspect, the wellbore is neither cased, nor gravel-packed, i.e. the production conduit and injections conduit are present in an open annulus.

The annulus between the conduits and the wellbore/formation interface in the present invention may be open (i.e. substantially free of formation components) or gravel packed. Independently of whether the annulus is open or gravel-packed, it may be lined or unlined.

In the two-well SAGD methods of the prior art, the producer is used as an injector in the melting phase in order to speed up melting between the wells. The producer thus needs to be re-completed before production can start. For example, the pump which is used in the producer to bring the oil and condensed steam to surface may not tolerate steam injection and thus would need to be installed after the pre-heating period so that it will only experience the somewhat cooler return-flow from the well. A further disadvantage of conventional two-well SAGD methods is that injecting through a pump which is not running may add an extra loss of pressure. To the extent that the production conduit need not be used for injection, the method and well of the invention have the advantage that there is no need to change configuration in the well after initial completion. Production can therefore commence essentially at the same time as injection.

In the method of the present invention, the oil close to the well will start to become mobilized (due to heating decreasing its viscosity) as soon as injection of the heating fluids commences. However, in early phases, the surface area of the formation which is exposed to the heating fluid is limited (i.e. only the parts of the formation in contact with the edge of the wellbore are exposed to the heating fluid at the beginning). Production is therefore relatively low at the beginning, and increases with time until equilibrium between the hydrocarbon production and the injection rate of the heating fluid is approached. To avoid too much heating fluid being returned to the well in the early production phase (this is a waste of energy), it may be necessary to restrict the flow of the heating fluid in this period, and increase it according to the increase in heat transfer capacity between the fluid and the formation (this increases with the increasing surface area of the heating fluid chamber as it penetrates the formation). Alternatively, if it is desired to commence production only when a certain production rate is reached a pre-heating step may be optionally included in the method of the invention.

Typical construction of a well for the method of the invention involves a first step of drilling a vertical or inclined hole down to the level of a heavy oil reservoir, followed by a substantially horizontal section which extends into the reservoir. Preferably, the vertical section of the wellbore is cased. The production and injection conduits are then inserted into the well, preferably such that the injection sections are staggered in relation to the production intervals (sections). The borehole is then preferably gravel-packed using standard methods well known in the art (see Example 2 for an example). If necessary, an inner tube may be used in the production or injection tube during gravel packing. Methods for constructing such wells are considered to form a further aspect of the present invention.

Figure 1A:
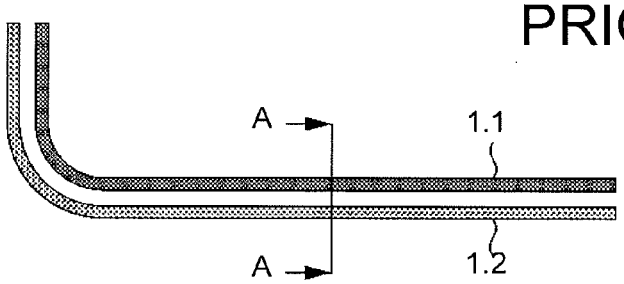
FIG. 1A PRIOR ART
FIG. 1A illustrates a conventional well pair using Steam Assisted Gravity Drainage.
Figure 1B:
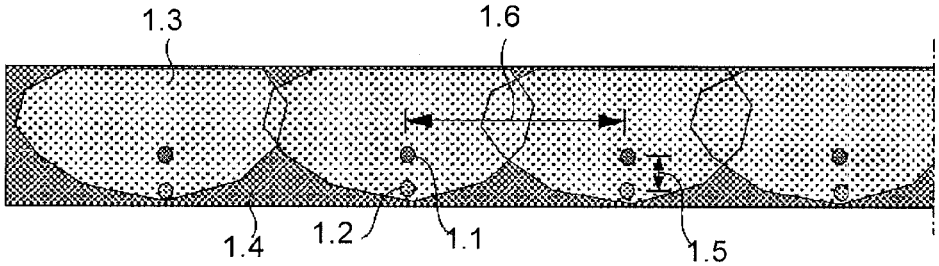
FIG. 1B is a cross-sectional view taking along line A-A of FIG. 1A.

A further advantage of the invention is that the well of the invention, to the extent that it is more cost effective than two-well systems, can be located in areas which would otherwise be unexploited, for example for reasons of economy. For example, a single well according to the present invention may be used in combination with traditional two-well SAGD, i.e. the single well of the invention may be placed in the undrained area (see the undrained wedge, 1.4 in FIG. 1B). Moreover, because the present invention requires only one well to inject and produce, it is more cost-effective than the two-well version. The related savings may render it economically feasible to use more wells than previously feasible and thus the spacing between neighbouring wells may be reduced with respect to the two-well versions. This can increase the proportion of drained formation. In these ways the amount of undrained formation can be reduced, making production more efficient. Use of the wells of the invention in this way and arrays of said wells thus forms a further aspect of the invention.

The wells according to the invention may be positioned in any regular or irregular arrangement, with each other or in combination with known wells (e.g. traditional SAGD or wedge well arrangements). For example, the wells may be positioned such that two upper wells are positioned substantially parallel to one another in a substantially horizontal plane and a lower well is located horizontally equidistant between the upper wells. Alternatively, the wells may be spaced equidistantly from each other in the horizontal plane, optionally with further rows of horizontally spaces wells above and/or below in which the wells of respective rows are positioned directly above/below one another, or are offset horizontally from one another.

Typically, in any of the aforementioned arrangements, neighbouring wells will be substantially parallel to one another, however they may be in any position suitable to maximise production from the hydrocarbon reservoir.

Preferably in the arrangements described herein, all neighbouring injection/production sections (whether they are in the same wellbore, or neighbouring wells) are staggered relative to one another. By staggered is meant that, when viewed from directly above (in the case of vertically spaced conduits or wells), no injection sections would overlap with production sections and vice versa.

In a particularly preferred embodiment, the present invention provides arrays of wells according to the invention, wherein neighbouring wells are configured such that their injection sections are staggered in relation to one another. As the production sections in any one well will be staggered in relation to its injection sections, the production sections of neighbouring wells will automatically be staggered in relation to one another, by virtue of the staggering of the injection sections.

The term "horizontal" as used herein should be understood to cover substantially horizontal, in fact, any well orientation in which conventional SAGD methods would work. For example, the well need not follow a straight path.

The invention will be further described with reference to the following non-limiting examples:

EXAMPLE 1

Well Construction and Hydrocarbon Production

1. Drill the first section of the well from surface to the start of the reservoir section and case this section.
2. Drill the (near) horizontal reservoir section.
3. Run-in two tubulars (conduits), one for steam injection and one for production. Production tubing will normally be equipped with a pump near the heel of the well. Prior to insertion into the well, the production tubular is equipped with discrete sand screen intervals along the reservoir section for oil (and condensate and some steam) inflow. The injection tubular is likewise equipped with discrete sand screen intervals for steam injection (also prior to insertion). The production screen intervals and injection screen intervals are staggered to avoid short-circuiting between injector and producer as shown, for example, in FIGS. 2 and 3 which show vertical cross sections of wells according to the invention.
4. To further improve heat distribution throughout the formation, the reservoir section is optionally gravel-packed (filled with permeable sand using the procedure of Example 2). The screen sections have to be optimized both with length and distance both with respect to production/injection situation and gravel packing operation by numerical simulation of the flow in the well and nearby reservoir. If necessary, screen sections may have to be modified by closing (or less likely by opening) some of them after gravel packing. It may also be necessary to add an intermediate inner tube for return flow in one of the conduits (production or injection) during gravel packing.
5. Start injecting steam. The steam will start to "melt" the oil in the formation around the borehole (especially in the upward direction). The steam will go further and further into the formation as more oil melts and make the oil bearing formation permeable (typically 1-10 Darcy). Oil will flow to the production intervals in the production tubular together with condensed steam and possibly some steam before it condenses and flows together with the oil into the producer.
6. In the case that the gravel does not completely fill the annulus in the reservoir section, a flow channel exists on the high side. This potentially causes a short-circuit for the steam, but is expected to be filled as a result of borehole collapse soon after heating starts.
7. To further control the flow pattern in the reservoir, inflow or outflow control devices can be used in one or both of the production and injection sections respectively.

EXAMPLE 2

Gravel Packing

A slurry of gravel (natural, carefully-sorted sand particles or artificial particles typically between 0.3 and 2 mm in diameter) and a carrier liquid (water, oil or gel) is pumped through the annulus of a well (outside the injection and production tubes). The liquid leaks through the screen section of the injection and production tubes and causes the gravel to settle along the horizontal section of the well. A so-called alpha-wave of gravel partly fills the open hole starting from the heel and moving towards the toe. When the toe is reached, a so-called beta-wave tops up the hole with gravel, starting from the toe and moving backwards towards the heel. As soon as the whole horizontal section is filled with gravel the pumping is stopped. In the event that parts of the reservoir section are not filled with gravel, reservoir sand may collapse as soon as the oil is melted in the vicinity of the borehole and fills the void.

The invention claimed is:

1. A method for recovering hydrocarbons from a sub-surface reservoir having present therein a wellbore in which a production conduit and an injection conduit are located, said method comprising injecting a heating fluid into the reservoir via said injection conduit, wherein said heating fluid is released via a plurality of discrete permeable sections located along the length of the injection conduit and produced hydrocarbons are collected via a plurality of discrete permeable sections located along the length of the production conduit, wherein said permeable sections located on the production conduit and permeable sections located on the injection conduit are staggered in relation to one another such that the permeable sections located along the length of the injection conduit are never position directly above, never position directly below and never positioned directly beside the permeable sections located along the length of the production conduit, and wherein the longitudinal axis of the injection conduit is parallel to the longitudinal axis of the production conduit.

2. The method as claimed in claim 1, wherein the permeable sections of the conduits are located in a substantially horizontal part of the wellbore.

3. The method as claimed in claim 2, wherein production and injection take place simultaneously.

4. The method as claimed in claim 2, wherein said heating fluid comprises one or more of steam, carbon dioxide, nitrogen, flue gas or $C_{1-6}$ hydrocarbons.

5. The method as claimed in claim 1, wherein production and injection take place simultaneously.

6. The method as claimed in claim 5, wherein said heating fluid comprises one or more of steam, carbon dioxide, nitrogen, flue gas or $C_{1-6}$ hydrocarbons.

7. The method as claimed in claim 1, wherein said heating fluid comprises one or more of steam, carbon dioxide, nitrogen, flue gas or $C_{1-6}$ hydrocarbons.

8. A well for the recovery of hydrocarbons from a sub-surface reservoir, said well comprising a wellbore in which a production conduit and an injection conduit are located, wherein the conduits each comprise a plurality of discrete permeable sections for the passing of fluids, wherein said permeable sections located on the production conduit and permeable sections located on the injection conduit are staggered in relation to one another such that the permeable sections located along the length of the injection conduit are never positioned directly above, never positioned directly below and never positioned directly beside the permeable sections located along the length of the production conduit, and wherein the longitudinal axis of the injection conduit is parallel to the longitudinal axis of the production conduit.

9. The well as claimed in claim 8, wherein the permeable sections of the conduits are located in a substantially horizontal part of the wellbore.

10. The well as claimed in claim 9, wherein the annulus between the conduits and a wellbore/formation interface comprises a gravel-pack.

11. The well as claimed in claim 8, wherein the annulus between the conduits and a wellbore/formation interface comprises a gravel-pack.

12. The well as claimed in claim 8, wherein the annulus between the conduits and a wellbore/formation interface is an open hole.

* * * * *